United States Patent [19]

Gruenewald

[11] Patent Number: 4,589,923

[45] Date of Patent: May 20, 1986

[54] APPARATUS FOR REMOVING LIQUID FROM FIBROUS MATERIALS

[75] Inventor: Werner Gruenewald, Wolfenbuettel, Fed. Rep. of Germany

[73] Assignee: Braunschweigische Maschinenbauanstalt, Brunswick, Fed. Rep. of Germany

[21] Appl. No.: 667,715

[22] Filed: Nov. 2, 1984

[30] Foreign Application Priority Data

Nov. 8, 1983 [EP] European Pat. Off. ..... 83111122.4
Oct. 3, 1984 [EP] European Pat. Off. ..... 84111788.0

[51] Int. Cl.[4] ..... C13D 1/02

[52] U.S. Cl. ..... 127/4; 100/121; 127/5; 127/43; 162/302; 210/326

[58] Field of Search ..... 100/70 A, 121; 127/2, 127/3, 4, 5, 6, 43; 162/302; 210/326, 402

[56] References Cited

U.S. PATENT DOCUMENTS

| | | | |
|---|---|---|---|
| 3,460,467 | 8/1969 | Nystrom | 100/121 |
| 3,697,324 | 10/1972 | Steele et al. | 127/2 |
| 4,043,832 | 8/1977 | Leibig et al. | 127/4 X |
| 4,310,361 | 1/1982 | Georget | 127/43 X |
| 4,452,641 | 6/1984 | Kaether | 127/43 |

FOREIGN PATENT DOCUMENTS

| | | | |
|---|---|---|---|
| 566820 | 2/1927 | Fed. Rep. of Germany . | |
| 634191 | 8/1936 | Fed. Rep. of Germany | 100/121 |
| 420314 | 8/1910 | France . | |
| 2070493 | 9/1971 | France . | |
| 2383009 | 10/1978 | France . | |
| 31674 | 12/1933 | Netherlands | 100/121 |
| 2017519 | 10/1979 | United Kingdom | 100/121 |

*Primary Examiner*—Richard V. Fisher
*Assistant Examiner*—W. Gary Jones
*Attorney, Agent, or Firm*—W. G. Fasse; D. H. Kane, Jr.

[57] ABSTRACT

Liquids, such as sugar cane juices, are removed from fibrous materials by an apparatus which receives the fibrous, felt type or matted materials in strand form, for example from a sugar cane diffuser. Two hollow compression rollers having perforated circumferential walls are pressed toward each other for working in a compression range of about 0.5 kg/cm$^2$ to about 50 kg/cm$^2$, and form a material feed-in gap facing substantially upwardly. The rollers are arranged above liquid collecting troughs. Lateral funnel forming walls sealingly close the ends of the feed-in gap so that the rollers together with these lateral walls form a feed-in funnel. Material entraining members cover the holes in the perforated circumferential roller walls but with a spacing between the outer roller wall surface and the respective entraining member to form a liquid flow channel into each hole. The material is supplied into the feed-in gap through a substantially vertically extending chute reaching to or into said funnel. The substantially vertically downwardly extending column of material in the chute assures a uniform and continuous material supply into the feed-in gap due to the pressure of the material column. Further, the liquids pressed out of the material between the rollers flow along the shortest possible path through the interior of the rollers into the collecting troughs.

19 Claims, 21 Drawing Figures

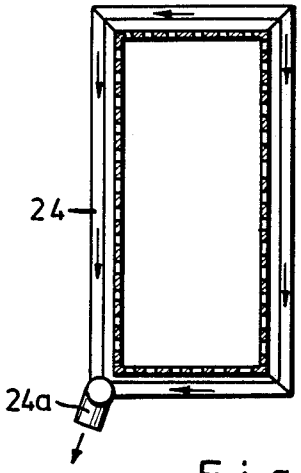
Fig.2b
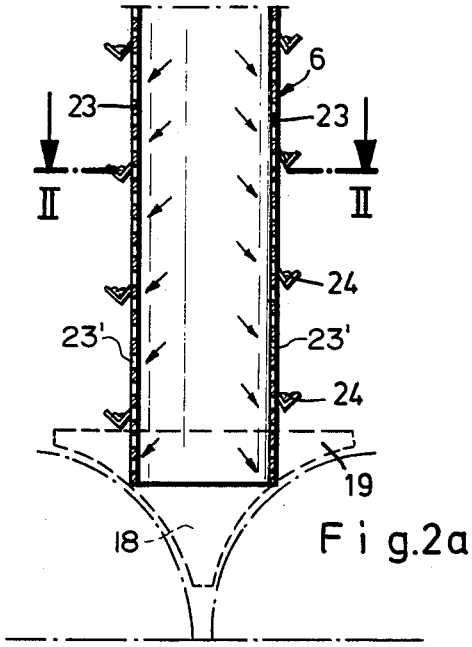
Fig.2a
Fig.3a
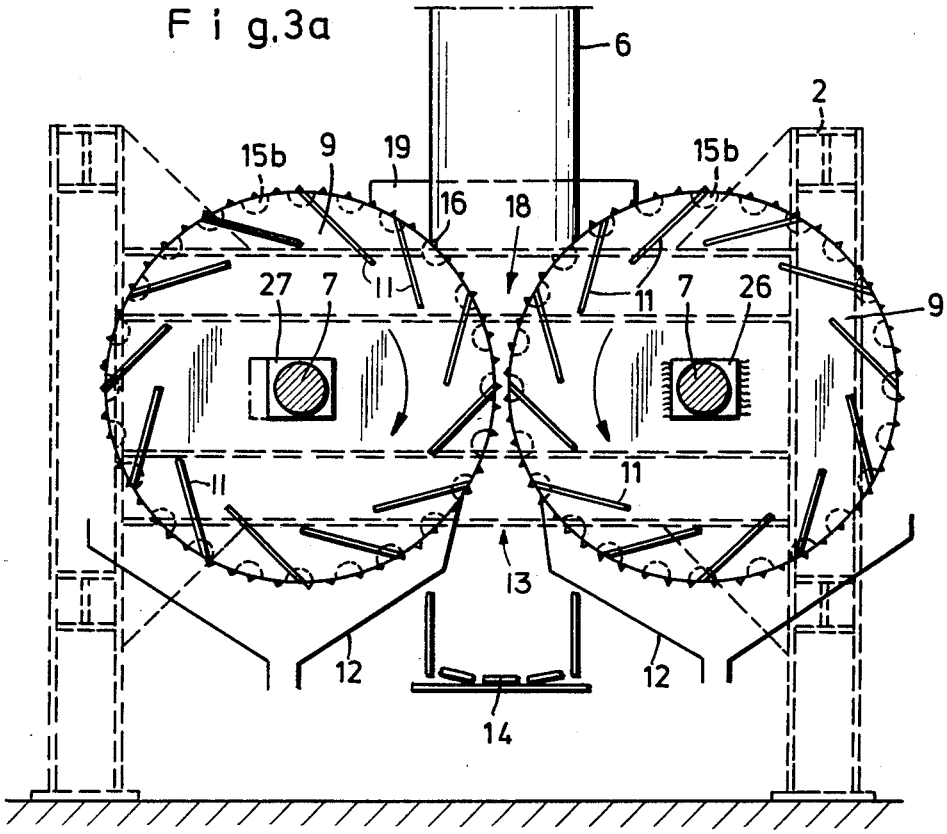

APPARATUS FOR REMOVING LIQUID FROM FIBROUS MATERIALS

FIELD OF THE INVENTION

The invention relates to an apparatus for removing liquid from fibrous, more specifically, from felt type or matted materials which become available as an extruded type strand. The present apparatus is especially suitable for dewatering sugar cane bagasse having a high moisture content. The materials, such as the bagasse, are supplied to the apparatus in a loosened form for passing through a gap between two cooperating compression rollers which in turn cooperate with respective liquid collecting troughs.

DESCRIPTION OF THE PRIOR ART

In connection with the dewatering of sugar cane bagasse it is intended that the respective dewatering apparatus is suitable for handling sugar cane bagasse resulting from a diffusion process as well as sugar cane bagasse from which the marrow has been removed. The latter type of sugar cane bagasse is used, for example, for further processing in the paper industry.

Devices for the dewatering of sugar cane diffusion bagasse are known in the art wherein the bagasse being extruded by the diffuser is first loosened up and then supplied in dosed quantities to the dewatering apparatus proper. Such dewatering apparatus may conventionally comprise either a structurally large and powerful high pressure three roller press or it may comprise two sequentially arranged high pressure three roller presses which are structurally smaller and less powerful or rather which have a lesser throughput capacity than the first mentioned structurally large three roller press. Both types of prior art roller presses which are also known as sugar cane mills involve rather expensive structures for which the expense rises with their throughput capacity. Besides, such mills are subject to a high wear and tear of their components. Additionally, the operation of such sugar cane mills requires substantial maintenance costs due to the high load to which the rollers, the bagasse cutters, the roller stripping blades, and the like are subject during their operation. Yet another disadvantage of prior art sugar cane mills is seen in that they have a relatively large power consumption and the respective high power input calls for correspondingly voluminous drive motors.

It is also known to arrange upstream of a sugar cane mill so-called low pressure dewatering rollers. Reference is made in this connection to U.S. Pat. No. 4,452,641 (Kaether), issued on June 5, 1984. The low pressure rollers in this prior art apparatus cooperated for the preliminary dewatering with a sieve constructed as a feed advance plane for the strand of material as it exits from the diffuser in a not yet loosened state. It is also known to perform the main dewatering by low pressure compression rollers instead of using sugar cane mills. These low pressure compression rollers are arranged as a pair at the end of the conveying plane over which the material strand travels, whereby these low pressure compression rollers exert a compression on the material strand before it has been loosened and for a time duration which is longer than is the case in sugar cane mills. In these low pressure long duration dewatering devices the two rollers are arranged one above the other, whereby the upper roller has a smooth circumferential surface while the lower roller has a perforated roller wall. In this type of application of the low pressure compression rollers the dewatering efficiency is relatively low already due to the thickness of the material strand which is supplied to the rollers and due to the matting or felting of the material fibers which also reduces the dewatering efficiency. Additionally, the flow off of the liquid is possible in but one direction, namely downwardly through the sieve on which the material strand travels or downwardly into the lower compression roller. As a result, most of the liquid must pass through a flow off path of substantial length during the compression, whereby the desired flow off quantity of the liquid during the compression is not achieved. Accordingly, it happens that pressed off liquid is taken up again by the material strand as it exits from the compression zone. Liquid pockets also occur.

OBJECTS OF THE INVENTION

In view of the above it is the aim of the invention to achieve the following objects singly or in combination:

to construct an apparatus for removing liquid or rather for a preliminary dewatering of a fibrous material that has been loosened, whereby the structural features shall result in a substantial reduction in the manufacturing and maintenance costs of the apparatus as compared with the respective costs for so-called sugar cane mills;

to construct the dewatering apparatus so that the energy consumption for the dewatering is also substantially reduced as compared to the prior art;

to improve the dewatering efficiency for the preliminary, as well as for the final dewatering and to assure an improved, as well as uniform liquid removal from the above mentioned types of materials;

to assure that most of the liquid pressed off can travel to its collection along the shortest possible path and as quickly as possible so that a reentry of the pressed off liquid into the fibrous material is prevented;

to supply the fibrous material into a feed-in gap in a loosened up form and in a uniform steady manner so that the static pressure of the fibrous material just upstream of the feed-in gap remains substantially constant;

to avoid the formation of liquid pockets inside the material flow, especially in the compression zone;

to make sure that the holes or openings through the cylindrical roller walls remain open and unclogged at all times;

to utilize a substantially vertically extending chute for the supply of the loosened up material into the feed-in gap for a preliminary liquid removal from the material even prior to its compression between the two compression rollers; and to utilize the present compression rollers for a preliminary and/or a main dewatering operation.

SUMMARY OF THE INVENTION

The apparatus according to the invention comprises two cooperating hollow compression rollers which are pressed toward each other in a low or medium pressure range from 0.5 to 50 kg/cm$^2$. The rotational central axes of the two rollers are located in a common horizontal plane and are supported in a frame for positive rotation by conventional drive means. The two rollers form a feed-in gap which is upwardly open and the lateral ends of which are closed in a sealed manner by funnel forming wall members. A material supply chute reaches with its lower end at least to the lateral funnel forming wall members and extends above the feed-in gap. The cross-sectional area of the supply chute encircles the cross-section of the feed-in gap. Additionally, the circumferential walls of both compression rollers are provided with openings as well as with radially projecting entraining members for the material being compressed. These entraining members may have the shape of knobs or they may be moldings provided with protuberances.

Contrary to the prior art (Käther) where the low pressure compression rollers receive the material strand in its still compressed form, the invention supplies the material to be subjected to a dewatering or to a preliminary dewatering in an already loosened up state, whereby, it has been found, a more efficient dewatering is accomplished with substantially less effort, especially a smaller power consumption is a very beneficial result.

BRIEF DESCRIPTION OF THE DRAWINGS

In order that the invention may be clearly understood, it will now be described, by way of example, with reference to the accompanying drawings, wherein:

FIG. 2*a* is a longitudinal section through the lower portion of the material supply chute in its position relative to a feed-in gap formed between the two rollers as illustrated in FIG. 1;

FIG. 2*b* is a horizontal sectional view through the chute of FIG. 2*a*, along section line II—II;

FIG. 3*a* shows on a scale somewhat enlarged relative to FIG. 1, a sectional view through the lower material supply chute and through the two compression rollers, whereby the machine frame is shown only in dashed lines to facilitate the illustration of the rollers;

DETAILED DESCRIPTION OF PREFERRED EXAMPLE EMBODIMENTS AND OF THE BEST MODE OF THE INVENTION

Figure 1:
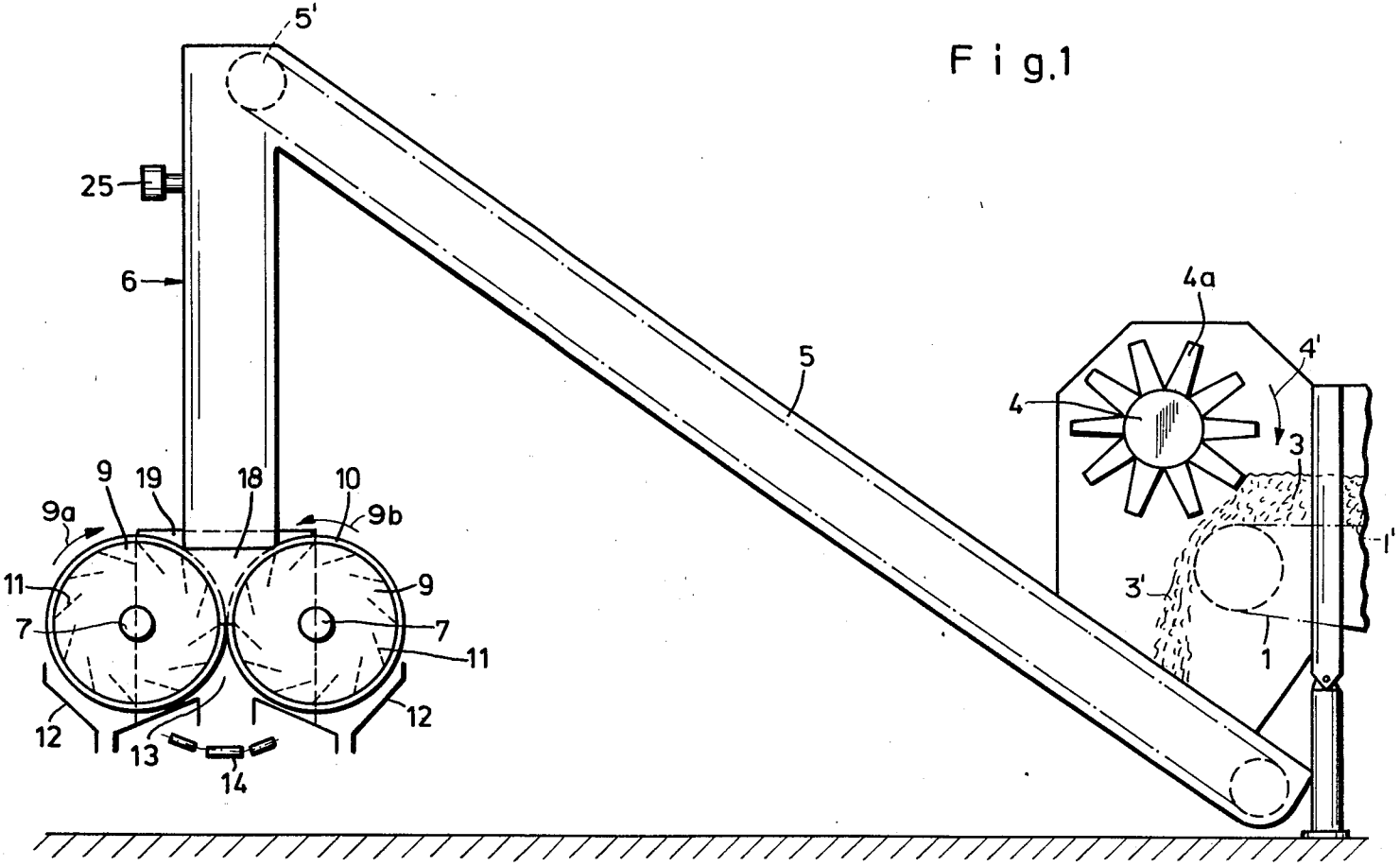
FIG. 1 is a schematic side view of an apparatus according to the invention employing a single pair of compression rollers for dewatering, for example, sugar cane bagasse which is being discharged from a diffuser.
Figure 7:
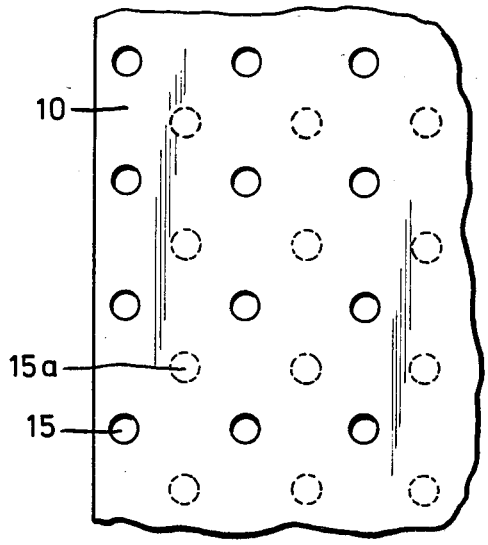
FIG. 7 shows schematically a development of a portion of the two circumferential, cylindrical surface walls of the two compression rollers.

FIG. 1 shows at its right side the discharge end of a conveyor 1, the upper run 1' of which forms a conveying plane. A relatively thick strand 3 of fibrous, felted or matted material moves from right to left with the upper run 1' of the conveyor 1, such material is in the present example, sugar cane bagasse as it emerges from a diffuser not shown in the drawing. A peeling and loosening roller 4 is operatively mounted for cooperation with the discharge end of the conveyor 1 for loosening the sugar cane bagasse 3 with the aid of radially extending beating or ripping arms 4*a* rotating in the direction of the arrow 4' for discharging the loosened up material 3' onto a further conveyor 5. The conveyor 5 is, for example, a scraper type conveyor which could also be arranged to extend at right angles to the output end of the conveyor 1. In the shown in-line arrangement the conveyor 5 would have a width, perpendicularly to the plane of FIG. 1, corresponding to the width of the conveyor 1. However, when the conveyor 5 is arranged to extend substantially at right angles to the output end of the conveyor 1 then the width of the conveyor 5 could be considerably smaller. The discharge end 5' of the conveyor 5 leads into an upper end of a material supply chute 6 extending substantially vertically downwardly, whereby the lower end of the chute 6 leads into a feed-in or compression gap 18 formed by a pair of compression rollers 9 having two rotational axles 7 extending in a common horizontal plane and in parallel to each other so that the feed-in or compression gap 18 opens substantially upwardly. The compression rollers 9 are operatively mounted in a machine frame 2 shown in FIG. 3*a* in dashed lines only since the machine frame 2 is of conventional construction. The axles 7 are operatively connected to drive means for rotating the right-hand compression roller 9 counterclockwise as shown by the arrow 9*b* and for rotating the left-hand roller in the clockwise direction as indicated by the arrow 9*a*. Both rollers 9 are driven in synchronism with each other so that both have the same circumferential speed since both rollers have the same effective diameter. The structural details of the compression rollers 9 will be described below. Suffice it to say at this point that the compression rollers 9 are constructed as hollow cylinders, each having a circumferential sheet metal wall 10 provided with perforations or openings 15, 15*a* as shown in FIG. 7.

Figure 8A:
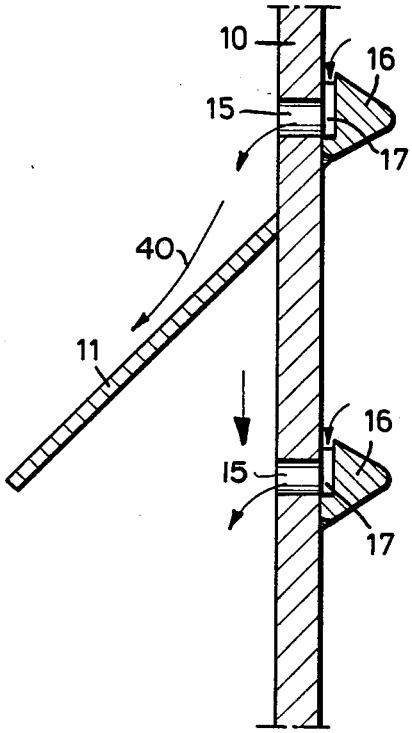
FIG. 8*a* shows on an enlarged scale a horizontal section through the two compression rollers, but illustrating only portions of the walls as they face each other across the feed-in or compression gap.

As shown in dashed lines in FIG. 1, guide vanes 11 are located inside the hollow compression rollers 9. These guide vanes 11 are inclined relative to the inner surface of the roller walls 10 so that the angle included between the vanes 11 and the respective inner wall surface opens in the rotational direction 9*a* or 9*b* respectively. The guide vanes 11 guide any liquid passing through the openings 15, 15*a* into the inner volume of the rollers to prevent liquid from flowing back into the bagasse which has already been subjected to the squeezing. Arrows 40 in FIG. 8*a* illustrate how the squeezed-out liquid is deflected into the inner volume of the rollers 9. FIGS. 1 and 3*a* further show liquid collecting troughs 12 located below each roller 9 for the liquid removal. A conveyor 14 is located below the discharge gap 13 for the removal of the bagasse from which the liquid has been pressed out.

Due to the guide vanes 11 the liquid passing into the rollers 9 through the holes 15, 15*a* adjacent to the squeezing zone, passes out of the same holes adjacent to the bottom zone of the rollers for flowing into the troughs 12. Normally, the end walls of the rollers 9 are entirely closed. However, it is also possible to provide the end walls with openings 15*b* shown in dashed lines in FIG. 3*a* for an additional removal of liquid and for cleaning.

The construction of the compression rollers 9 according to the invention is important for the proper liquid removal. The construction of the rollers 9 will now be described with reference to FIGS. 7, 8*a*, 8*b*, as well as 9*a* to 9*f*.

FIG. 7 shows a developed portion of a wall 10 of the two compression rollers 9. The full line holes 15 are located in one roller 9 while the dashed line holes 15*a* are located in the other roller 9. FIG. 7 illustrates that the two sets of holes 15, 15*a* are staggered relative to each other in the axial direction of the axles 7 as well as in the circumferential direction.

Figure 8B:
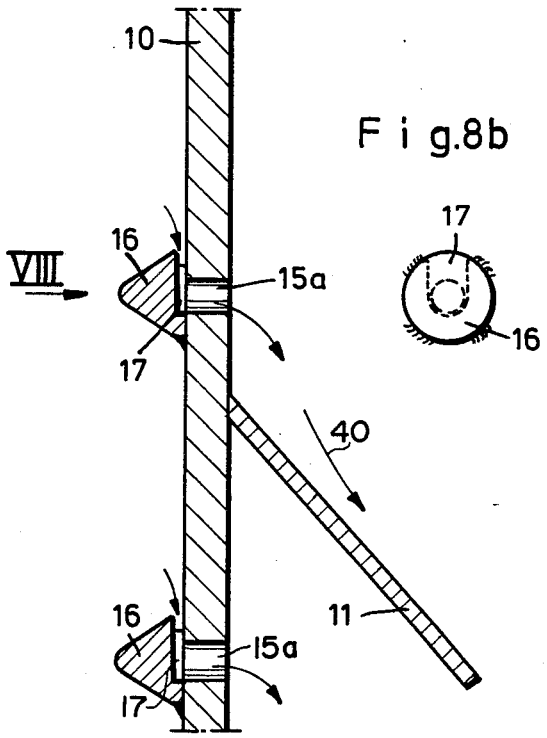
FIG. 8*b* is a view in the direction of the arrow VIII in FIG. 8*a;*

As shown in FIGS. 8*a* and 8*b* the holes 15 and 15*a* are covered on the outer surface of the respective roller wall 10 by material entraining members 16 which form individual knobs or wart-like projections spaced from the respective surface around the corresponding hole 15, 15*a* to form a flow channel 17. All the flow channels 17 open in the direction away from the compression zone, whereby the entry of liquid into the flow channels 17 and thus into the respective holes 15, 15*a* is substantially facilitated and improved. As best seen in FIG. 8*b* the entraining member 16 substantially encircles the respective hole, except for the flow channel 17 which faces upwardly or in the direction away from the compression zone below the entraining member 16.

Figure 9D:
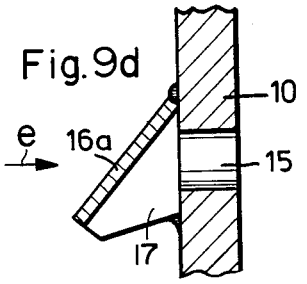
FIG. 9*d* is a view similar to that of FIG. 9*a*, but showing a further modification of a material entraining member.
Figure 9E:
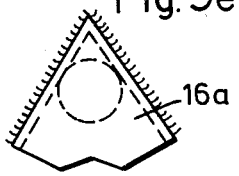
FIG. 9*e* is a view in the direction of the arrow e in FIG. 9*d;*
Figure 9F:
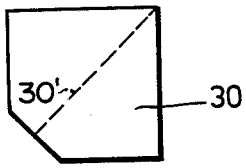
FIG. 9*f* is a developed plan view of the entraining member of FIG. 9*d;*
Figure 9A:
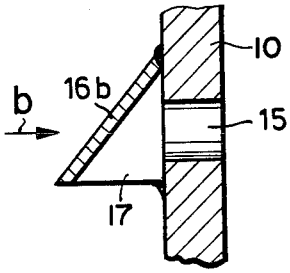
FIG. 9*a* is a sectional view similar to that of FIG. 8*a* but showing only a portion of the right-hand compression roller with a modified material entraining member.
Figure 9B:
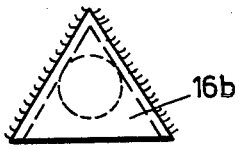
FIG. 9*b* is a view in the direction of the arrow b in FIG. 9*a;*
Figure 9C:
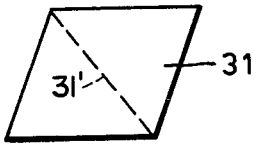
FIG. 9*c* is a developed plan view of the entraining member of FIG. 9*a;*

FIGS. 9*a*, 9*b* and 9*c* illustrate one type of entraining member 16*b* made of sheet metal, whereby the arrow b in FIG. 9*a* shows the viewing direction for FIG. 9*b*. The entraining member 16*b* is made of a pattern 31 cut out of sheet metal and shown in FIG. 9*c*. The pattern 31 is bent along the dashed line 31' and then welded to the surface of the roller wall 10. The modified entraining member 16*a* shown in FIG. 9*d* is also made of sheet metal and welded to the surface of the roller wall 10 as shown in FIG. 9*e* which is a view in the direction of the arrow e in FIG. 9*d*. The entraining member 16*a* is cut out of sheet metal in accordance with the pattern 30 shown in FIG. 9*f* and bent along the line 30'. Both embodiments 16*a* and 16*b* of the entraining members are so constructed that they substantially encircle the respective hole 15, 15*a* except for the flow channel 17 which opens, as mentioned, in the direction away from the compression zone. In other words, the flow channel 17 faces with its opening in a direction opposite to the respective rotational direction of the compression rollers 9. These entraining members 16, 16*a*, 16*b* make sure that the liquid pressed out of the bagasse can freely flow through the respective holes 15, 15*a* in the walls 10 of the compression rollers 9 without any difficulties for collection inside the rollers 9 and for discharge through the same holes downwardly as mentioned above, whereby any danger of clogging of the openings 15, 15*a* is substantially avoided. Since the holes are staggered relative to each other as mentioned above, the entraining members 16, 16*a* 16*b* are also correspondingly staggered, whereby the transport of the material to be squeezed through the squeezing or compression gap 18 is greatly facilitated due to the alternate gripping of these entraining members into the bagasse to be dewatered by the compression between the rollers 9.

Figure 5:
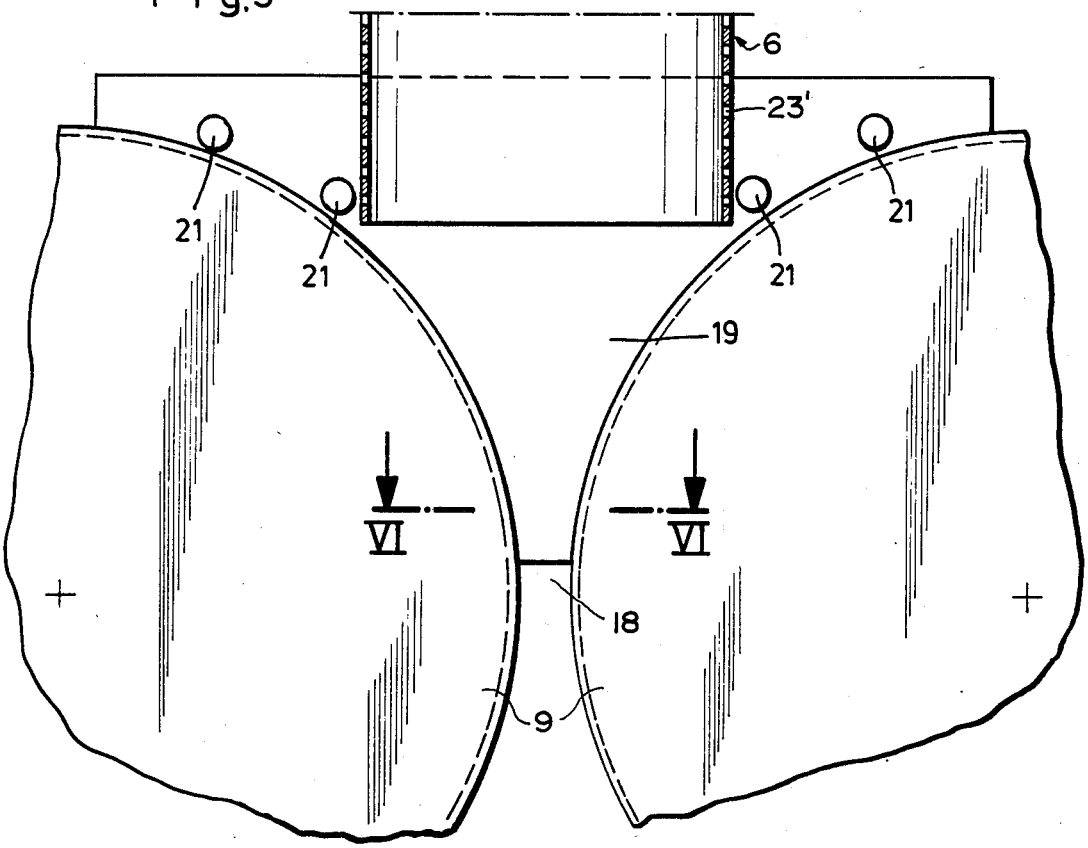
FIG. 5 shows on an enlarged scale a side view of the feed-in gap between the two compression rollers.
Figure 6:
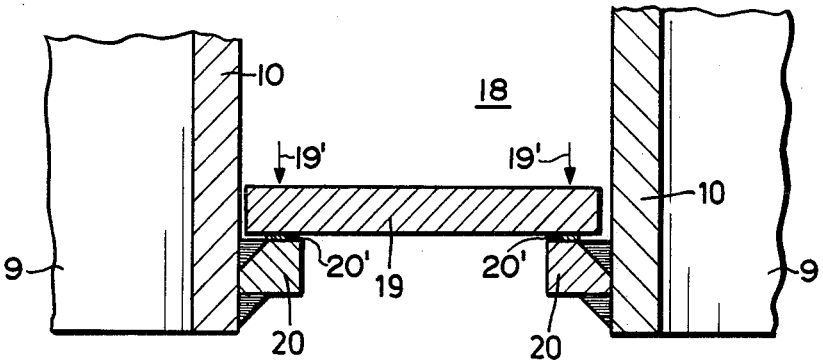
FIG. 6 is a sectional view along section line VI—VI in FIG. 5.

As shown, for example, in FIGS. 1 and 5, as well as 6, the feed-in or compression gap 18 is closed at both ends by lateral wall members 19 forming together with the outer surface of the two rollers 9 a funnel shaped inlet into the compression gap 18. The lower end of the lateral wall members 19 is so contoured that it conforms to the contour of the feed-in or compression gap 18. The lateral walls 19 are either rigidly or movably supported by the machine frame 2 in a conventional manner. Preferably, each roller 9 is provided at each of its ends with a radially extending sealing ring 20 as shown in FIG. 6. To further improve the sealing of the end closures of the gap 18 sealing members 20' may be interposed between the lateral walls 19 and the rings 20. Friction resistance material will be suitable for these sealing members 20' between the lateral walls 19 and the rotating rings 20. The walls 19 reach with their lower ends substantially to the plane defined by the rotational axes of the two roller axles 7 and the just mentioned lateral sealing members 20' are desirable in this lower zone. However, it is also desirable to provide the upper end of the walls 19 with apertures 21 for the easy flow-out of any liquid that may already be passing out of the bagasse in this upper zone of the feed-in gap. Rather than mounting the lateral walls 19 in a stationary position, it may also be desirable to mount these walls 19 in a movable manner for a slight displacement in the axial direction as indicated by the arrows 19' in FIG. 6. These arrows 19' represent, for example, a spring force which tends to press the respective wall 19 against the sealing member 20'. For this purpose the walls 19 may be mounted on a respective guide means or the like for a very slight axial displacement.

Figure 3B:
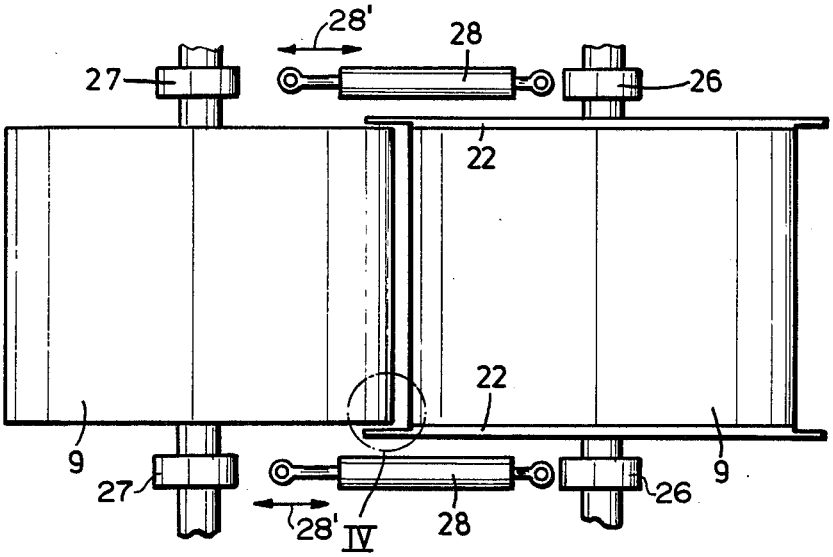
FIG. 3*b* is a schematic top plan view of the rollers according to FIG. 3*a*, however with the material supply chute removed.
Figure 4:
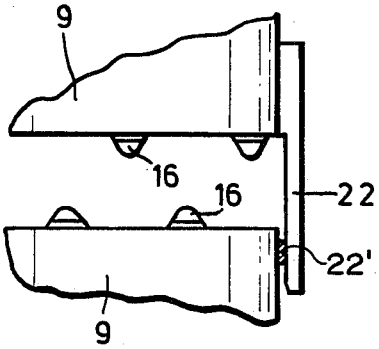
FIG. 4 shows on an enlarged scale the top plan view of the portion in FIG. 3*b* encircled by the circle IV.

FIGS. 3*b* and 4 illustrate another embodiment for sealing the ends of the feed-in gap 18 by two flange rings 22 connected to one of the rollers 9 or, one ring 22 could be connected to one end of one roller while the other ring 22 is connected to the opposite end of the other roller. In any event, the rings 22 have a sufficient radial extension to reach over and cover part of the other roller to form a sealing gap with a sealing member 22' as shown in FIG. 4. The material of the sealing member 22' must be resistant against wear and tear by friction.

The construction of the material supply chute 6 shown in FIG. 1 will now be described, particularly with reference to FIG. 2*a* and FIG. 2*b*. The dimensions which define the cross-section of the chute 6 with its walls 23 are so selected that the cross-sectional area of the lower chute end conforms to the feed-in or compression gap 18. The inner surfaces of the walls 23 are preferably smooth so that the sliding down of the material inside the chute is properly assured. The vertical height of chute 6 is so selected that a sufficient static pressure on the material being fed into the feed-in gap 18 is assured to advance the material by gravity into the gap 18 between the rollers 9 in a uniform and continuous manner. Additionally, it has been found to be especially advantageous to perforate the walls 23 with openings 23' and to surround the chute 6 at several levels with liquid collecting gutters 24 which all lead into a collection conduit 24a as shown in FIGS. 2a and 2b. An effective preliminary dewatering of the material in the chute is thus possible due to the static pressure on the material inside the chute. Although it is convenient to arrange a plurality of collecting gutters 24 at intervals along the length of the chute 6, it is also possible to use but one collecting gutter near the lower end of the chute 6. In any event, the gutter will lead into a collecting conduit 24a as mentioned above. Where a plurality of gutters are used, they may form one continuous gutter winding around the chute 6 in a helical manner.

FIG. 1 shows in a schematic manner the arrangement of a filling level control device 25 located near the top of the chute 6 to assure a sufficiently high column of material in the chute 6 and thus a sufficient static pressure of the material onto the feed-in or compression gap 18. The control device 25 also assures a uniform and continuous supply of material to the rollers 9. For this purpose the height of the material column in the chute 6 should always be the same or constant. Preferably, the filling level control device 25 includes a sensor for example, a light sensitive diode and a light source to provide a signal when there is no material between the light source and the light sensitive diode. Such signal is supplied as a control input to the drive means for the input conveyor 1 or even to the drive means for the rollers 9 if there should be no material or insufficient material in the chute 6.

FIGS. 3a and 3b show that the right-hand compression roller 9 is supported by bearings 26 held in a fixed position in the frame 2. On the other hand, the axle or shaft 7 of the left-hand compression roller 9 is supported in a bearing 27 which is slidably mounted in the machine frame 2 for an adjustment movement back and forth as indicated by the arrows 28' in FIG. 3b. By displacing the left-hand roller 9 relative to the right-hand roller 9 it is possible to adjust the width of the feed-in or compression gap 18. Such adjustment may be accomplished, for example, by conventional hydraulic piston cylinders 28 symbollically shown in FIG. 3b.

Figure 10:
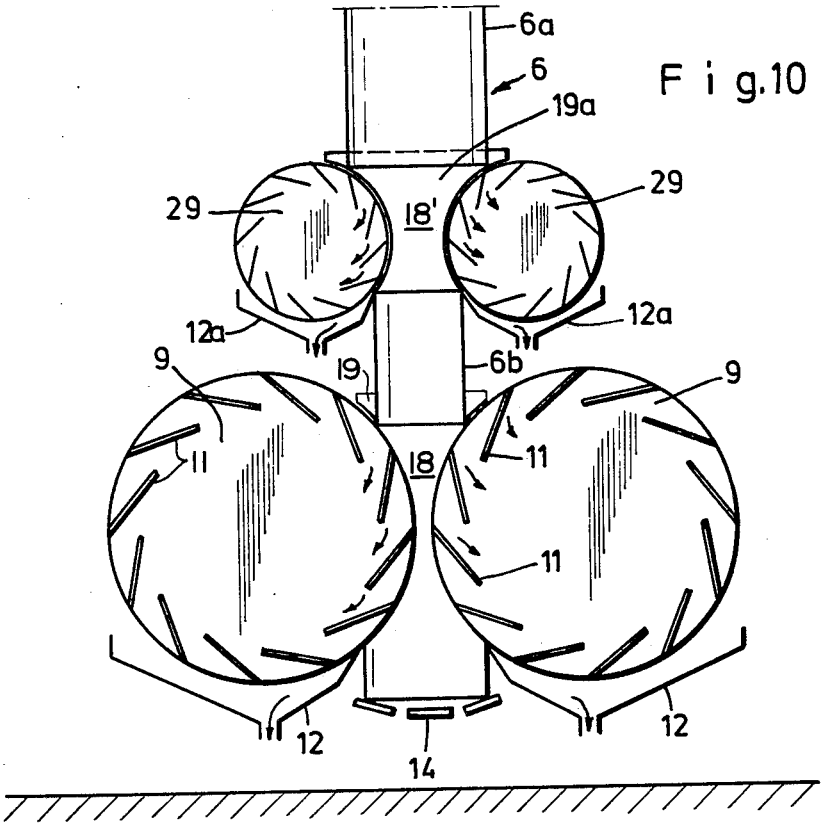
FIG. 10 is a view similar to that of FIG. 3*a*, however, showing two sets of compression rollers, one above the other for providing a preliminary liquid removal and a final liquid removal in sequence.

FIG. 10 illustrates an embodiment of the invention wherein a preliminary dewatering is accomplished by a set of compression rollers 29 arranged substantially vertically above the main compression rollers 9. The preliminary dewatering compression rollers 29 may be provided in addition to a chute 6 with perforated walls which also provides a preliminary dewatering. Alternately, the chute 6 in FIG. 10 may have walls without perforations. The rollers 29 are also mounted for positive driving in the frame 2. The drive means are not shown since they are conventional. The rollers 29 have the same construction as the rollers 9, except for a smaller diameter to form a wider preliminary squeezing gap 18' than the main squeezing gap 18 between the rollers 9. Here again one or both rollers 29 can be mounted to be adjustable in their position horizontally toward and away from each other for adjustment of the width of the gap 18'. Collecting troughs 12a are operatively located below the rollers 29 for collection of the liquid removed by the preliminary compression.

Referring further to FIG. 10 the material supply chute 6 comprises an upper section 6a above the rollers 29 and a lower section 6b below the rollers 29 and above the rollers 9. The upper section 6a has a larger cross-sectional area than the lower section 6b because the volume of the material passing through the gap 18' has been reduced due to the preliminary water removal in the gap 18' by the rollers 29. The upper section 6a reaches into a funnel also formed by gap closing end walls 19a as described above with reference to the lateral walls 19. Incidentally, these lateral walls 19 are also provided in FIG. 10 for closing the ends of the gap 18 adjacent to the lower chute section 6b.

In addition to the mentioned preliminary liquid removal by the rollers 29, the latter also function simultaneously to assure a uniform supply of material to be squeezed into the gap 18 between the compression rollers 9 independently of any possible variations in the material column in the chute section 6a above the rollers 29. Thus, the rollers 29 make sure that the pressure of the material being supplied into the gap 18 is a predetermined substantially constant pressure. It has been found that maintaining this pressure at a predetermined level advantageously facilitates obtaining a high dewatering degree, for example, that the moisture remainder is only about 85% by weight of the material exiting onto the conveyor 14, as compared to a remainder moisture content of about 65% by weight of the output material in an apparatus as shown in present FIG. 1. In the example embodiment of FIG. 1 with a single pair of rollers 9 each having a diameter of 1.2 m and providing a compression of 6 kg/cm$^2$ at the narrowest width of the gap 18, while operating at a circumferential speed of 4.5 m/minute, the remaining moisture content was 65% by weight of the material exiting onto the conveyor 14 and provided the starting sugar cane bagasse supplied into the chute had a moisture content of 82% by weight of the starting material.

Figure 11:
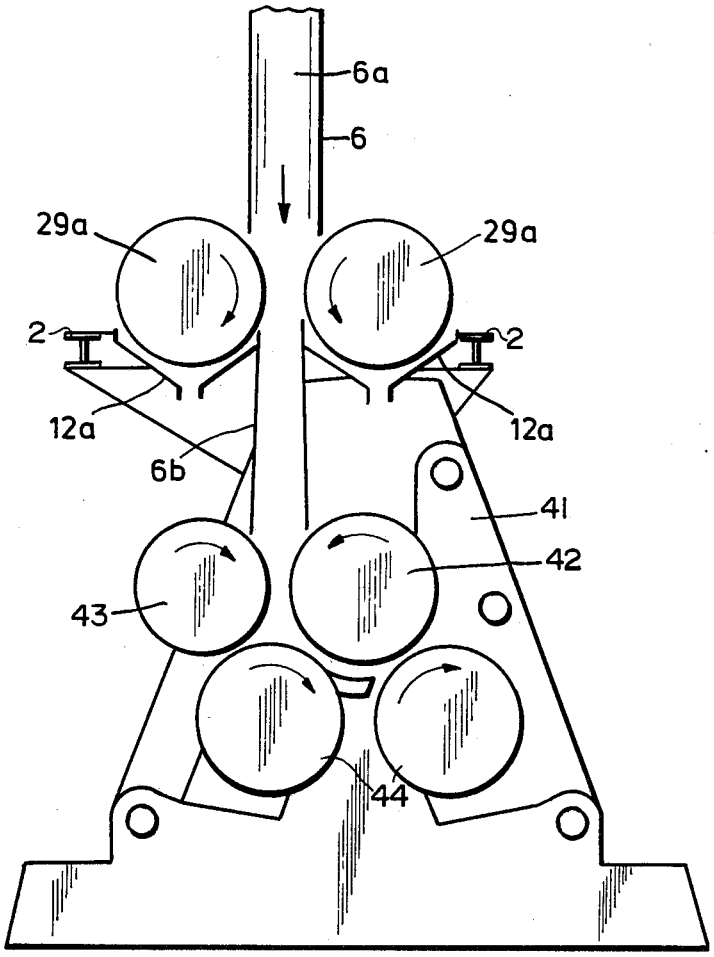
FIG. 11 shows a schematic side view of an apparatus according to the invention arranged for cooperation with a conventional sugar cane mill.

FIG. 11 is an embodiment similar to that of FIG. 10, however, showing a set of preliminary dewatering compression rollers 29a arranged upstream of the inlet of a conventional sugar cane mill 41. The arrangement in FIG. 11 is substantially the same as in FIG. 10 with a wider chute section 6a above the preliminary dewatering rollers 29a and a narrower, intermediate chute section 6b below the rollers 29a and above the inlet rollers 42, 43 of the sugar cane mill 41. Downstream of the inlet rollers 42, 43 the mill comprises a conventional set of further rollers 44 both rotating in the clockwise direction while the rollers 42, 43 operate in a counter rotating fashion. Preferably, the chute sections 6a and 6b are arranged vertically and perpendicularly to the horizontal plane defined by the rotational axes of the rollers 29a. Liquid collecting troughs 12a are located below the preliminary dewatering rollers 29a just as in FIG. 10.

The rollers 29a and the feed advance roller 43 as well as the inlet roller 42 of the sugar cane mill 41 are all connected in common to a conventional drive mechanism not shown. Thus, a separate drive motor for the rollers 29a is not required.

By arranging the preliminary dewatering compression rollers 29a as an inlet to the sugar cane mill 41 as shown in FIG. 11, a very intensive and highly efficient preliminary dewatering can be achieved, whereby it has become possible to use a sugar cane mill 41 of relatively smaller dimensions than has been possible heretofore. As a result, the sugar cane mill 41 can also be driven by a power drive requiring a correspondingly smaller power input while nevertheless achieving a high degree of liquid removal by the entire system. Yet another advantage of the arrangement according to the invention is seen in that it may be incorporated in already available dewatering systems, whereby the retooling is relatively simple while the improvement in the dewatering degree is very substantial without the need of arranging a plurality of sugar cane mills in series.

Figure 12:
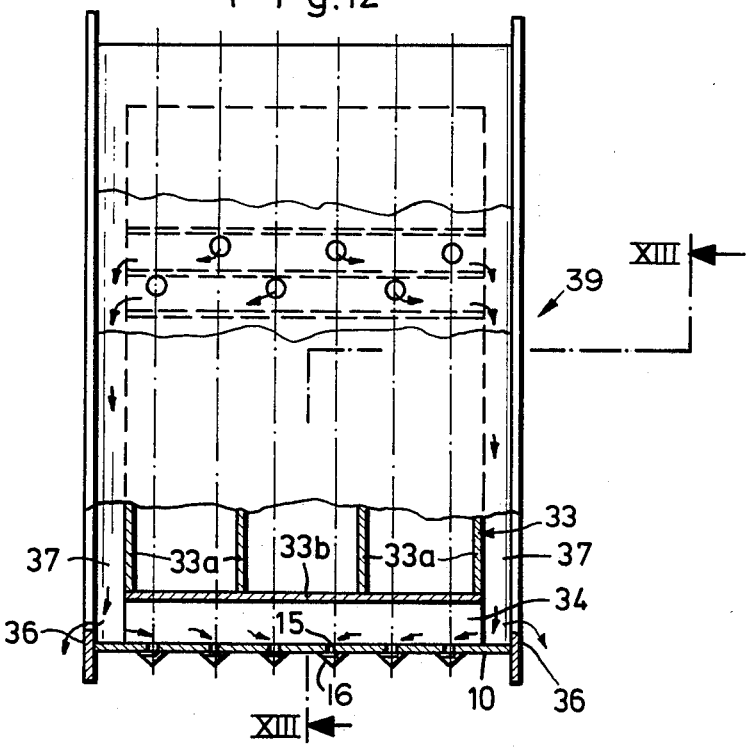
FIG. 12 is a plan view of a modified compression roller according to the invention comprising a double circumferential wall.
Figure 13:
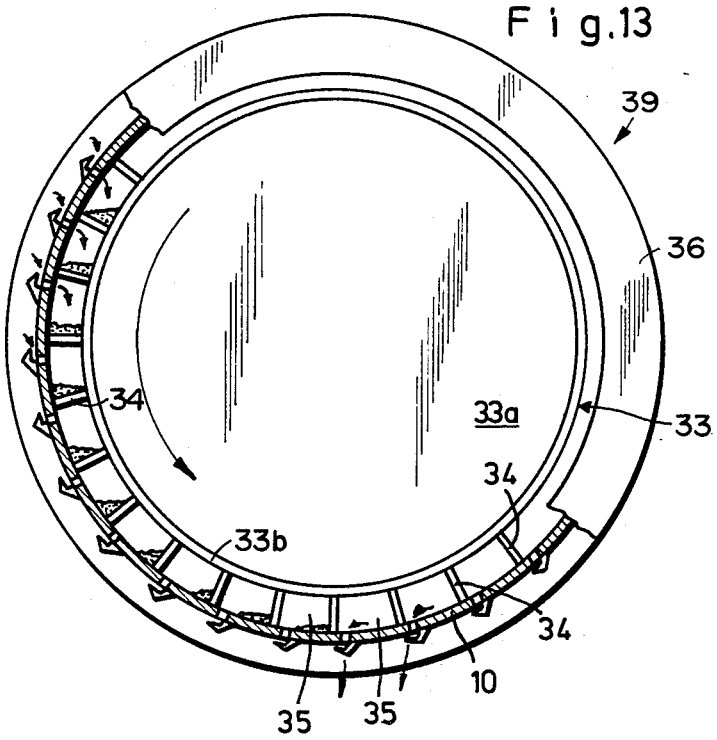
FIG. 13 is a sectional view along section line XIII—XIII in FIG. 12.

Rather than using the internal guide vanes 11 for the liquid as described above, it is possible to construct the compression rollers as shown in FIGS. 12 and 13 and to use such modified double walled compression rollers instead of the rollers 9, 29, and 29*a*.

The modified roller 39 of FIGS. 12 and 13 corprises an outer circumferential wall 10 identical to the wall 10 in the above described rollers. The wall 10 forms an outer cylinder which completely surrounds an inner cylinder 33 which is completely closed, whereby the circumferential wall 33*b* of the inner cylinder 33 is stiffened by radially extending wall members 33*a*. The outer cylindrical wall 10 is secured to the inner cylinder 33 by spacer members 34. Additionally, the outer cylindrical wall 10 is axially longer than the inner cylinder 33 to form two disc type cylindrical spaces 37 at each end of the inner cylinder 33. Two flanges 36 are secured to the axial ends of the outer cylindrical wall 10 which is also provided with the above mentioned holes or openings 15 and the material entraining members 16 as described.

As best seen in FIG. 13, the spacer members 34 extend radially between the circumferential wall 33*b* of the inner cylinder 33 and the outer circumferential cylindrical wall 10 to form chambers 35 in which the liquid flows as indicated by the respective arrows in FIGS. 12 and 13. Here again, adjacent to the compression gap 18 the liquid flows into the chambers 35 through the holes 15, 15*a* while at the bottom of the chambers 35 the liquid flows out of these holes. Additionally liquid may pass through the spaces 37 and out of the double walled roller adjacent to the flanges 36 as also shown by respective arrows in FIG. 12.

The flanges 36 may be replaced by substantially closed plates or discs, whereby these discs would be provided with windows substantially in alignment with the chambers 35 for the efficient liquid removal from these chambers 35 as they sequentially reach their lowest position during their rotation It has been found that the spacer members 34, for example made of sheet metal, result in a structurally simple, however in combination with the inner roller 33 rather strong and rigid construction. Further, it has been found that deposit of fibrous material inside the chambers 35 is rather minimal The drums constructed as just described are also easily cleaned because it merely takes a water stream directed alongside the chambers 35 for such cleaning operation.

Although the present apparatus has been described with reference to the dewatering of sugar cane bagasse as it exits from a diffuser, the present apparatus is equally suitable for the dewatering from sugar cane bagasse from which the marrow has been removed. Additionally, the present apparatus may be used for the liquid removal from any other type of fibrous, felted or matted material in the form of natural fibers or even in the form of synthetic fibers.

The compression rollers 9, 29, 29*a* of an apparatus according to the invention can be made of relatively thin walled sheet metal cylinders due to the low working pressure under which the present rollers work. This is so even if the cylinders or rollers have substantial diameters in order to achieve a sufficient residence time of the material between the rollers. Thus, the present rollers may have diameters in the range of 1.0 to 2.5 m. Further, by providing both rollers of a pair with the openings 15, 15*a* it is assured that the maximal travel distance of any liquid quantity to a collection point is one half of the gap width between the two rollers. This feature assures a relatively rapid flow off of the liquid into the inner volume of both rollers, whereby the guide vanes 11 or chambers 35 help guiding the collected liquid to the holes at the lowest point of the rollers for flowing out of the rollers. Thus, the liquid flow into the rollers is as fast as the liquid flow out of the rollers and into the collection troughs 12, 12*a*.

It is important for an efficient operation of the compression rollers 9, 29, 29*a* that the materials are supplied not only in a loosened up condition, but also in a uniform constant stream. The invention achieves this by the material supply chute 6 which makes it possible to maintain the material column above the gap 18 and thus the static pressure constant. This static pressure permits a preliminary dewatering through the holes 23' in the walls 23 of the chute 6. Additionally, the constant static pressure assures a uniform liquid removal from the material throughout the material cross-section or volume and without the formation of hollow pockets within the material flow. Thus, the accumulation of liquid in such hollow pockets is also prevented. Maintaining a column of uniform height in the chute 6 is easily achieved by synchronizing the drive of the conveyor 1 with the drive of the compression rollers 9. The formation of hollow pockets within the material being squeezed is further reduced by driving the two compression rollers with a synchroneous circumferential speed and by arranging the entraining members 16, 16*a*, 16*b* on one roller in a staggered relationship relative to the entraining members on the other roller so that the entraining members reach into the material being squeezed in an alternate fashion.

By making sure that the entraining members 16, 16*a*, 16*b* cover the respective hole 15, 15*a* completely while simultaneously leaving the flow channels 17 open, as shown in FIG. 8*a*, clogging of the holes 15, 15*a* is avoided and a rapid liquid flow off is assured. Incidentally, the holes 15, 15*a* may have any desirable shape for example, they need not be round, but may be elongated slots or the like. The most efficient flow off with a simultaneous avoidance of clogging is assured when the flow channels 17 face with their open end in the low pressure direction, whereby the closed sides of the entraining members 16 move into the material. This feature also improves the flow off and avoids clogging.

The lateral closing of the feed-in gap 18 by walls 19 conforming to the contour of the rollers 9, 29, 29*a* and by rings 20 on the rollers as shown in FIG. 6 or by flanges 22 as shown in FIG. 4, it is important for keeping the material in the gap and for preventing liquid from flowing laterally out of the gap. The embodiment of FIG. 6 has the advantages that the seal 20' is very effective for keeping the liquid in the gap 18 since a labyrinth type seal is formed, and that any liquid being squeezed out at the top of the gap 18 may flow along the rollers in a direction opposite to the roller rotation for direct collection in the troughs 12, 12*a* without flowing through the rollers. This is possible because the rings 20 keep the liquid on the top surface of the rollers. Thus, the embodiment of FIG. 6 is especially suitable for dewatering materials having a high liquid content.

However, the embodiment of FIG. 4 is also very satisfactory, especially if the flanges 22 have a substantial radial width for closing the lateral ends of the gap 18.

Incidentally, the piston cylinder devices 28 for the adjustment of the width of the gap 18 may be connected between the axles 7 of the two rollers, whereby one axle is horizontally movable, whereas the other axle is mounted in a stationary bearing. Thus, the gap width and also the squeezing pressure are easily adjustable.

The use of two sets of rollers 9 and 29 as shown in FIG. 10 is recommended where materials having a high moisture content are to be dewatered. The preliminary dewatering rollers 29 may have a diameter substantially smaller than the second set of rollers 9. For example, the diameter of the rollers 29 may range from 0.3 to 0.65 times the diameter of the larger rollers 9 in FIG. 10. Otherwise, both sets of rollers are of identical construction.

Where the preliminary dewatering in a sugar cane mill is accomplished by rollers as disclosed herein and as shown in FIG. 11, such a system becomes especially simple if the preliminary dewatering rollers 29*a* are driven by the drive system of the sugar cane mill. A subsequent installation in an existing sugar cane mill of the rollers according to the invention does not pose any problems.

By constructing the rollers 9, 29, 29*a* with open sides, or with double circumferential walls and with open sides as shown in FIGS. 12 and 13 the cleaning operation is greatly facilitated. In rollers constructed as shown in FIGS. 12 and 13, the function of the guide vanes 11 is taken over by the spacer members 34 forming the chambers 35 between the outer and inner drum walls.

Although the invention has been described with reference to specific example embodiments, it will be appreciated that it is intended to cover all modifications and equivalents within the scope of the appended claims.

What is claimed is:

1. An apparatus for removing liquid from fibrous materials, comprising means for supplying said fibrous materials to said apparatus, a pair of hollow compression rollers, each roller having perforated circumferential wall means with open holes in said roller wall means, frame means including bearing means for operatively supporting said compression rollers, each of said compression rollers having a rotational roller axis extending horizontally in the same horizontal plane as the respective other horizontal axis, said compression rollers operating in a range of relatively low compression frame about 0.5 kg/cm$^2$ to about 50 kg/cm$^2$, said compression rollers forming a feed-in gap facing substantially upwardly for receiving fibrous material, funnel wall means forming in a sealing manner an inlet funnel into said feed-in gap, material supply chute means extending substantially vertically and leading to said inlet funnel for feeding material into said feed-in gap, said chute means having a predetermined upward length for establishing a sufficiently high column of fibrous material above said feed-in gap to assure a substantially constant static pressure at said feed-in gap, and material entraining members operatively secured to said circumferential walls of said compression roller means, said material entraining members extending substantially radially out of said compression roller means, said material entraining members being arranged in a staggered relationship relative to one another on said circumferential wall means of said compression rollers such that entraining members on one compression roller are alternately effective on material in said feed-in gap relative to entraining members on the other compression roller and vice versa.

2. The apparatus of claim 1, wherein said chute means have a lower end opening sufficient in size for encircling said feed-in gap, said lower end opening reaching into said inlet funnel.

3. The apparatus of claim 1, wherein said perforated circumferential wall means of said compression rollers have flow openings therein for permitting liquid to flow into said compression rollers, said entraining means comprising an entraining member for each of said openings, each entraining member covering its respective hole with a spacing between the circumferential roller wall and the corresponding entraining member for forming a flow channel into each opening.

4. The apparatus of claim 3, wherein said entraining members enclose said flow openings on all sides except where said flow channel is formed and so that said flow channel opens in a circumferential direction opposite to the rotational direction of the respective compression roller.

5. The apparatus of claim 1, further comprising guide vanes operatively located inside said compression rollers for guiding liquid flowing inside said compression rollers, said guide vanes extending at an angle relative to the inner surface of said circumferential roller wall means and pointing approximately in the rotational direction of the respective compression roller whereby a trough formed between an inner wall surface of the compression roller and the respective guide vane opens substantially in the rotational direction.

6. The apparatus of claim 1, wherein said funnel wall means comprise lateral wall members (22) forming radially outwardly extending flanges on at least one of said two compression rollers, said flanges covering the lateral ends of said feed-in gap in a sealing manner, said flanges rotating with the respective compression roller.

7. The apparatus of claim 1, wherein said funnel wall means comprise lateral wall members having lower ends contoured corresponding to the cross-sectional contour of said feed-in gap, said lateral wall members being supported by said frame means for closing in a sealing manner the lateral ends of said feed-in gap above said roller axes and adjacent to the ends of said compression rollers, said compression rollers comprising circumferential ring members located adjacent to said roller ends for sealing cooperation with the adjacent contoured lower end of said lateral wall members.

8. The apparatus of claim 7, wherein said lateral wall members are supported for movement in the longitudinal direction of said feed-in gap, and spring means arranged for pressing said lateral wall members against said circumferential ring members in a sealing manner.

9. The apparatus of claim 1, wherein said material supply chute means comprises perforated chute walls for liquid to pass through said perforated chute walls, liquid collecting gutter means operatively secured to the outside of said perforated chute walls, and a liquid collecting conduit operatively connected to said liquid collecting gutter means.

10. The apparatus of claim 1, wherein said material supply chute means comprise filling condition control means for controlling the filling status of said material supply chute means.

11. The apparatus of claim 1, wherein said bearing means for said compression rollers comprise adjustable bearing members for at least one of said compression rollers, whereby said compression rollers are adjustable relative to each other for adjusting the width of said feed-in gap and thus the pressure in said feed-in gap.

12. The apparatus of claim 1, further comprising a pair of preliminary liquid removal rollers operatively arranged above said first mentioned pair of compression rollers, and wherein said material supply chute means comprise two sections including a first chute section located above said preliminary liquid removal rollers for feeding material into a slot between said preliminary liquid removal rollers, and a second chute section operatively located between said pairs of rollers.

13. The apparatus of claim 12, wherein said first chute section has a width in a horizontal direction across said slot which is larger than a respective width of said second chute section whereby said slot is also wider than said feed-in gap, said second chute section extending from an exit of said slot to said feed-in gap.

14. The apparatus of claim 12, wherein said preliminary liquid removal rollers have a diameter smaller than said compression rollers, said preliminary liquid removal rollers also being hollow and comprising perforated circumferential walls and liquid guide vanes inside said preliminary liquid removal rollers, said apparatus further comprising additional funnel wall members (19*a*) for laterally closing the ends of said slot, and liquid collecting trough means (12*a*) operatively located below said preliminary liquid removal rollers (29).

15. The apparatus of claim 1, wherein said circumferential wall means of said compression rollers comprise two cylindrical walls forming for each compression roller a double wall, said two cylindrical walls including an outer perforated wall and an inner non-perforated wall for enclosing a cylindrical ring space between the two walls, said compression rollers further comprising spacer members (34) extending radially and longitudinally between said two cylindrical walls for dividing said ring space into a plurality of liquid collecting chambers, said compression rollers further comprising end walls for each of said two cylindrical walls, said end walls for said outer perforated cylindrical wall having openings therein located to provide open ends for said liquid collecting chambers for removing liquid from said chambers.

16. The apparatus of claim 15, wherein said spacer members (34) have an axial length corresponding to the axial length of said inner non-perforated wall, and wherein said end walls of said outer cylindrical wall comprises ring flanges extending radially inwardly to partially cover said liquid collecting chambers.

17. The apparatus of claim 16, wherein said ring flanges extend radially outwardly of said outer perforated cylindrical wall.

18. The apparatus of claim 1, further comprising a sugar cane mill, said compression rollers being arranged above said sugar cane mill for a preliminary dewatering, said material supply chute means comprising a first section above said compression rollers and a second section between said compression rollers and said sugar cane mill, said second section being narrower than said first section.

19. The apparatus of claim 18, further comprising common drive means for said sugar cane mill and for said compression rollers for driving said sugar cane mill and said compression rollers in synchronism with each other.

* * * * *